US009629462B2

(12) United States Patent
Fu

(10) Patent No.: US 9,629,462 B2
(45) Date of Patent: Apr. 25, 2017

(54) MODULAR DRAWER STRUCTURE

(71) Applicant: BESTMATE INTERNATIONAL DEVELOPING CO., LTD., Yilan County (TW)

(72) Inventor: Kuang-Huan Fu, Yilan County (TW)

(73) Assignee: BESTMATE INTERNATIONAL DEVELOPING CO., LTD., Yilan County (TW)

( * ) Notice: Subject to any disclaimer, the term of this patent is extended or adjusted under 35 U.S.C. 154(b) by 0 days.

(21) Appl. No.: 15/180,079

(22) Filed: Jun. 12, 2016

(65) Prior Publication Data

US 2017/0086582 A1 Mar. 30, 2017

(30) Foreign Application Priority Data

Sep. 24, 2015 (TW) ..... 104215461 U

(51) Int. Cl.

| | |
|---|---|
| ***A47B 88/00*** | (2006.01) |
| ***A47B 95/02*** | (2006.01) |
| ***A47B 88/90*** | (2017.01) |
| *A47B 88/95* | (2017.01) |

(52) U.S. Cl.

CPC ..... *A47B 88/941* (2017.01); *A47B 95/02* (2013.01); *A47B 2088/952* (2017.01); *A47B 2095/026* (2013.01); *A47B 2210/04* (2013.01); *A47B 2210/19* (2013.01)

(58) Field of Classification Search

CPC . A47B 88/0014; A47B 88/04; A47B 2210/04; A47B 2210/19; A47B 2088/004; A47B 88/941; A47B 2088/952; A47B 95/02

USPC ..... 211/126.15

See application file for complete search history.

(56) References Cited

U.S. PATENT DOCUMENTS 1,352,002 A * 9/1920 Jones ..... A47B 88/0014 220/4.28
1,890,983 A * 12/1932 Griffith ..... B65D 7/26 220/485
1,916,852 A * 7/1933 Sutton ..... F25D 25/022 211/126.15
2,502,781 A * 4/1950 Erickson ..... B60R 9/04 220/491

(Continued)

FOREIGN PATENT DOCUMENTS

DE 3940550 A1 * 6/1991 ..... A47B 88/0022

*Primary Examiner* — Stanton L Krycinski
(74) *Attorney, Agent, or Firm* — Leong C. Lei

(57) ABSTRACT

A modular drawer structure mainly includes a bottom board and front, rear boards and side boards coupled to the bottom board, where the boards each has an outer frame and a positioning frame configured on the inner edge of the outer frame, the outer frame is configured with buckling elements and engagement grooves, and a mesh sheet body constituted by interwoven net threads is configured on the positioning frame. Whereby, the front, rear boards and side boards are allowed to be positioned vertically on the peripheral of the bottom board by means of the mutual engagement of buckling element and engagement grooves of the outer frame of each board with each other in such a way to form a box-typed drawer. In addition, all the boards may be detached from each other and stacked together so as to facilitate handling and storage while not in use.

5 Claims, 6 Drawing Sheets

(56) References Cited

U.S. PATENT DOCUMENTS 3,120,323 A * 2/1964 Sparling ..... B65D 21/048 206/505
4,120,551 A * 10/1978 Godtschalck ..... A47B 88/941 220/691
4,466,675 A * 8/1984 Ferdinand ..... A47B 88/941 312/263
4,887,538 A * 12/1989 Arnold ..... A47B 17/00 108/185
5,810,179 A * 9/1998 Kleiman ..... A47B 61/00 211/106
D419,302 S * 1/2000 Hardy ..... D19/75
D451,675 S * 12/2001 Hardy ..... D3/306
6,508,376 B1 * 1/2003 Chiang ..... B42F 15/0094 211/46
D476,155 S * 6/2003 Post ..... D6/705.6
D481,233 S * 10/2003 Post ..... D6/675.1
D486,981 S * 2/2004 Post ..... D6/675.1
6,718,635 B2 * 4/2004 Cheng ..... A47B 55/02 220/485
D501,105 S * 1/2005 Post ..... D6/705
7,228,985 B2 * 6/2007 Yeh ..... B65D 7/20 220/485
7,270,245 B2 * 9/2007 Cheng ..... A47B 55/02 211/126.15
7,428,976 B2 * 9/2008 Cheng ..... A47B 55/02 220/485
8,006,858 B2 * 8/2011 Cheng ..... A47B 55/02 220/485
8,141,737 B1 * 3/2012 Tsai ..... B65D 7/14 220/485
D676,715 S * 2/2013 Tsai ..... D7/600.1
D679,954 S * 4/2013 Snider ..... D7/600.1
D689,946 S * 9/2013 Hu ..... D19/92
D698,604 S * 2/2014 Tsai ..... D6/705.6
D698,605 S * 2/2014 Tsai ..... D6/705.6
8,985,374 B2 * 3/2015 Tsai ..... B65D 7/20 220/4.28
9,149,112 B2 * 10/2015 Yeh ..... A47B 47/00
2005/0140256 A1 * 6/2005 Wang ..... A47B 88/0014 312/265.5
2009/0295261 A1 * 12/2009 Leng ..... A47B 47/04 312/265.5
2011/0221318 A1 * 9/2011 Chen ..... A47B 88/0014 312/263
2013/0181590 A1 * 7/2013 Chen ..... A47B 88/0014 312/330.1
2014/0042113 A1 * 2/2014 Cheng ..... A47B 55/02 211/126.15
2014/0061143 A1 * 3/2014 Hu ..... A47B 88/04 211/133.5
2014/0265787 A1 * 9/2014 Sabounjian ..... A47B 97/00 312/334.1
2015/0208801 A1 * 7/2015 Hu ..... A47B 88/0085 312/334.27
2016/0144999 A1 * 5/2016 Tang ..... B65D 7/14 220/493

* cited by examiner

MODULAR DRAWER STRUCTURE

TECHNICAL FIELD OF THE INVENTION

The present invention relates to a modular drawer structure, and more particularly to a box-shaped drawer constituted by buckling component boards to one another and capable of being detached and then stacked together so as to be convenient for handling, storage when not in use.

DESCRIPTION OF THE PRIOR ART

Drawers used in general cupboards or combined cupboards are generally constituted by a bottom board, front board, rear board and side boards, allowing the drawers to be formed as boxes so as to be slid into the cupboard for the accommodation of clothes or other various articles. Since conventional drawers are fixed, being inconvenient in handling upon purchase, and occupy too large storage space when not in use because they are larger. Although some pieces of modular furniture are provided with self-assembly drawers and can overcome the defects upon handling and storage, the assemblies thereof are rather troublesome such that the designs thereof cannot be counted as ideal ones.

SUMMARY OF THE INVENTION

The main object of the present invention is to provide a modular drawer structure, allowing a drawer to be assembled by means of mutual engagement, and further making the assembly more simple and convenient, and capable of detachment and stacking so as to facilitate handling and storage when not in use.

To achieve the object mentioned above, the present invention proposes a modular drawer structure, including a bottom board and front, rear boards and side boards coupled to the bottom board, where the boards each has an outer frame and a positioning frame configured on the inner edge of the outer frame, the outer frame is configured with buckling elements and engagement grooves, and a mesh sheet body constituted by interwoven net threads is configured on the positioning frame. Whereby, the front, rear boards and side boards are allowed to be positioned vertically on the peripheral of the bottom board by means of the mutual engagements of buckling elements and engagement grooves of the outer frame of each board with each other in such a way to form a box-typed drawer. In addition, all the boards may be detached from each other and stacked together so as to facilitate handling and storage when not in use.

Furthermore, the mesh sheet bodies are respectively configured with floating protrusions spaced at intervals in such a way to strengthen the respective mesh sheet body.

Furthermore, the end portions of the net threads of the mesh sheet bodies are wound around the respective positioning frames, allowing the end portions to be sandwiched between the respective outer frames and positioning frames so as to make the mesh sheet bodies more stable.

DETAILED DESCRIPTION OF THE PREFERRED EMBODIMENTS

Figure 1:
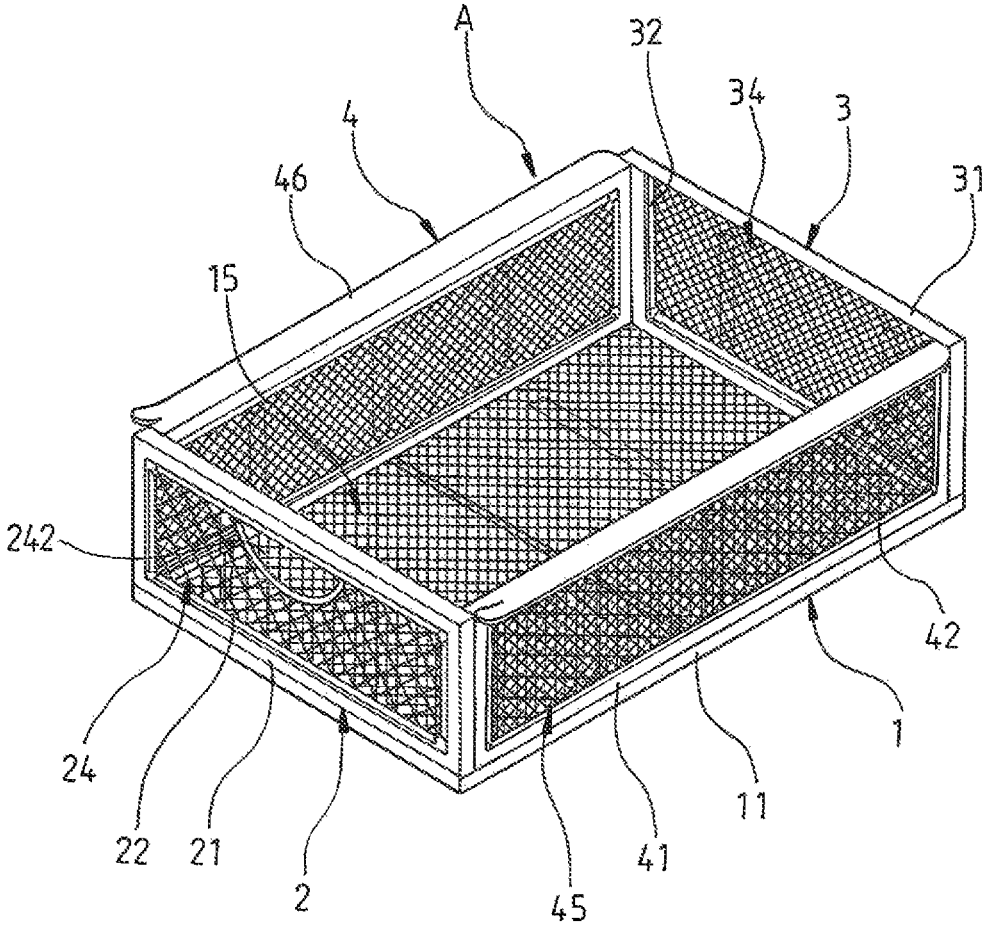
FIG. 1 is a perspective view of the present invention.
Figure 2:
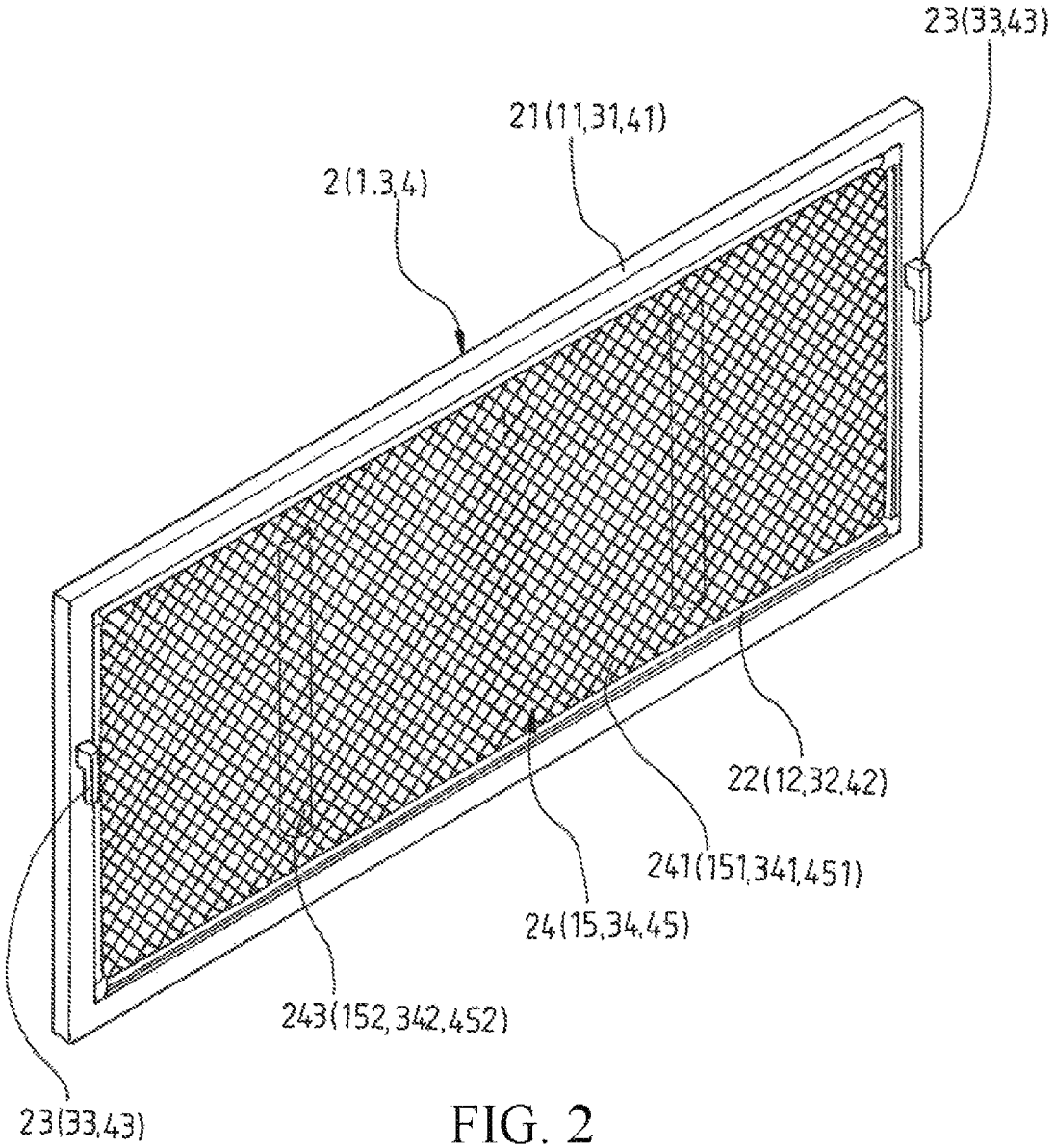
FIG. 2 is a perspective view of a board according to the present invention.
Figure 3:
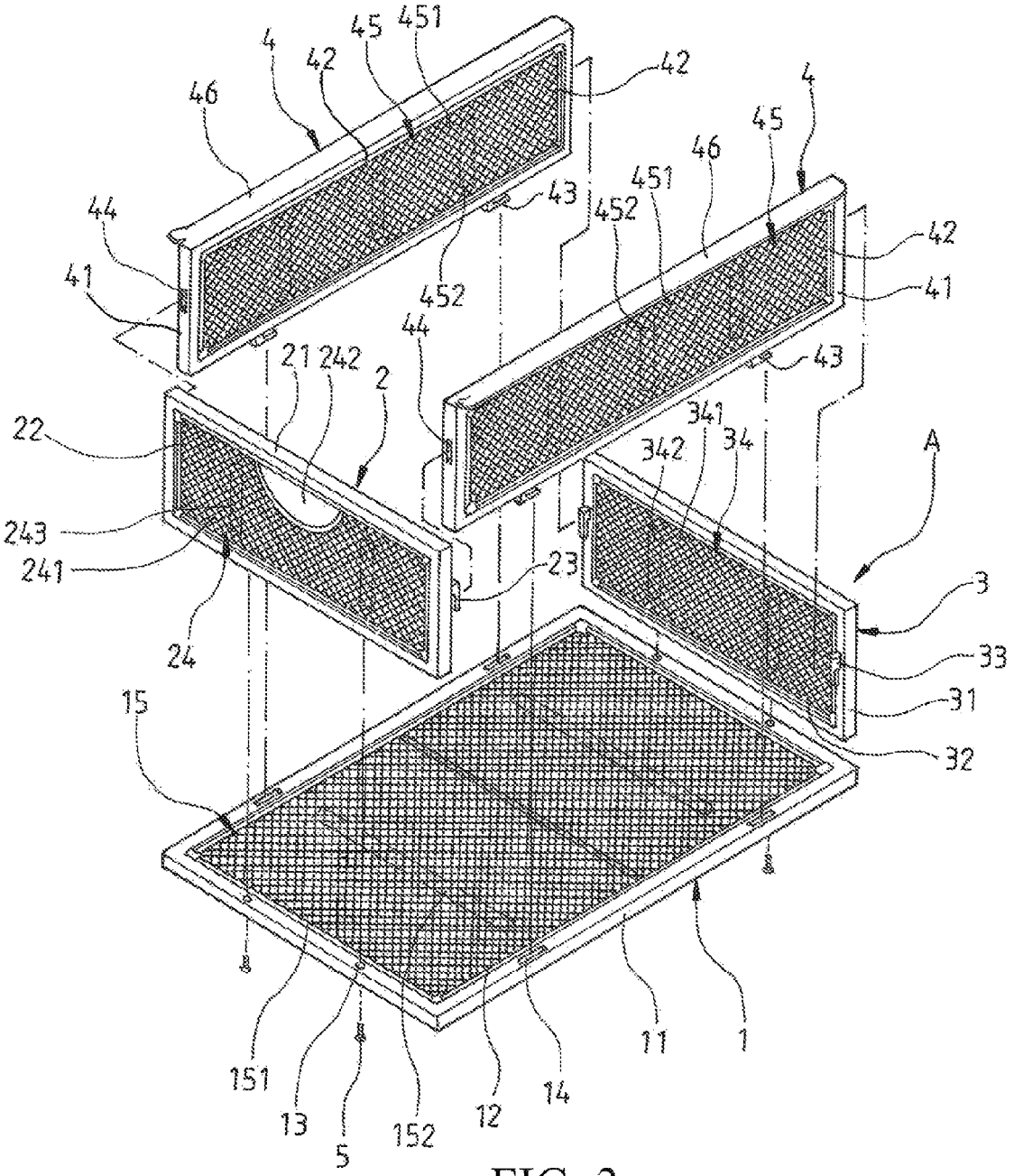
FIG. 3 is an exploded view of the present invention.

Referring to FIGS. 1 to 3, which respectively are a perspective view of the present invention, a perspective view of a board according to the present invention and an exploded view of the present invention, a drawer of the present invention includes a bottom board 1 and a front board 2, rear board 3 and two side boards 4 coupled to bottom board 1 and each other, where the bottom board 1 is configured with an outer frame 11 and positioning frame 12 configured on the inner edge of the outer frame 11, and the front, rear edges of the outer frame 11 are respectively configured with fixing holes 13 and the two sides thereof engagement grooves 14. Furthermore, the positioning frame 12 is configured with a mesh sheet body 15 constituted by interwoven net threads 151, which is configured with floating protrusions arranged at intervals in such a way to increase the strength of the mesh sheet body 15.

The front board 2 is configured with an outer frame 21 and a positioning frame 22 configured on the inner edge of the outer frame 21, the rear edge of the outer frame 21 is configured with buckling elements 23, and the positioning frame 22 is configured with a mesh sheet body 24 constituted by interwoven net threads 241, with the mesh sheet body 24 being configured with a semicircular opening 243 and floating protrusions 242 spaced at intervals in such a way to strengthen the mesh sheet body 24. Furthermore, the bottom edge of the outer frame 21 is configured with screw holes (not shown in the figures) corresponding to the fixing holes 13 configured on the outer frame 11 of the bottom board 1.

The rear board 3 is configured with an outer frame 31 and a positioning frame 32 configured on the inner edge of the outer frame 31, the front edge of the outer frame 31 is configured with buckling elements 33, and the positioning frame 32 is configured with a mesh sheet body 34 constituted by interwoven net threads 341, with the mesh sheet body 34 being configured with floating protrusions 342 spaced at intervals in such a way to strengthen the mesh sheet body 24. Furthermore, the bottom edge of the outer frame 21 is configured with screw holes (not shown in the figures) corresponding to the fixing holes 13 configured on the outer frame 11 of the bottom board 1.

The two side boards 4 each is configured with an outer frame 41 and a positioning frame 42 configured on the inner edge of the outer frame 41, the bottom edge of the outer frame 41 is configured with buckling elements 43, and the front and rear edges thereof are respectively configured with an engagement groove 44. Furthermore, the positioning frame 42 is configured with a mesh sheet body 45 constituted by interwoven net threads 451, the mesh sheet body 45 is configured with float protrusions 452 spaced at intervals in such a way to strengthen the mesh sheet body 45, and a wall portion 46 projected outward is configured on the top edge of the outer frame 41.

The components mentioned above are combined together to form a modular drawer structure. Therefore, the mutual engagements of the buckling elements 23, 33, 43 and engagement grooves 14, 44 configured on the outer frames 11, 21, 31, 41 of the bottom board 1, front board 2, rear board 3 and two side boards 4 with each other upon assembly enable the front board 2, rear board 3 and two side board 4 to be positioned vertically on the peripheral of the bottom board 1 and, screws 5 are then used to pass through the fixing holes 13 of the bottom board 1 to lock down the front board 2 and rear board 3 in such a way to constitute a box-typed drawer A. Thus, the drawer A so constituted may be slid into a cupboard through the wall portions 46 configured on the side boards 4 for the accommodation of clothes or other various articles, allowing the assembly of the drawer A to be more convenient and quick. When not in use, all the boards may be detached from each other and then stacked together in order to facilitate handling and storage.

Figure 4:
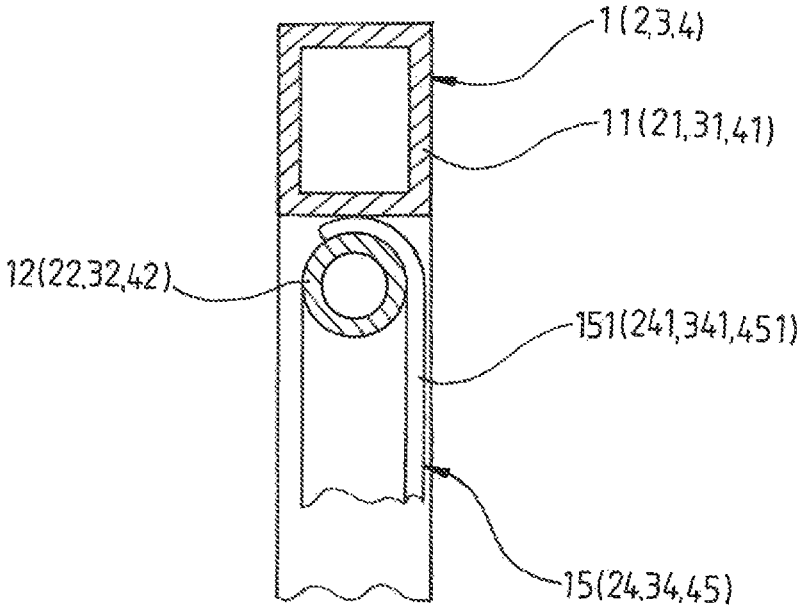
FIG. 4 is a cross-sectional view of an explanatory net thread of a mesh sheet body according to the present invention after assembly.

Referring to FIG. 4, which is a cross-sectional view of mesh sheet body net threads according to the present invention after assembly, the end portions of the net threads 151, 241, 341, 451 of the mesh sheet bodies 15, 24, 34, 45 of the bottom board 1, front board 2, rear board 3 and two side boards 4 are respectively wound around the positioning frames 12, 22, 32, 42, allowing the end portions to be sandwiched between the outer frames 11, 21, 31, 41 and positioning frames 12, 22, 32, 42 so that the mesh sheet bodies 13, 24, 34, 45 can be fixed more firmly.

Figure 5:
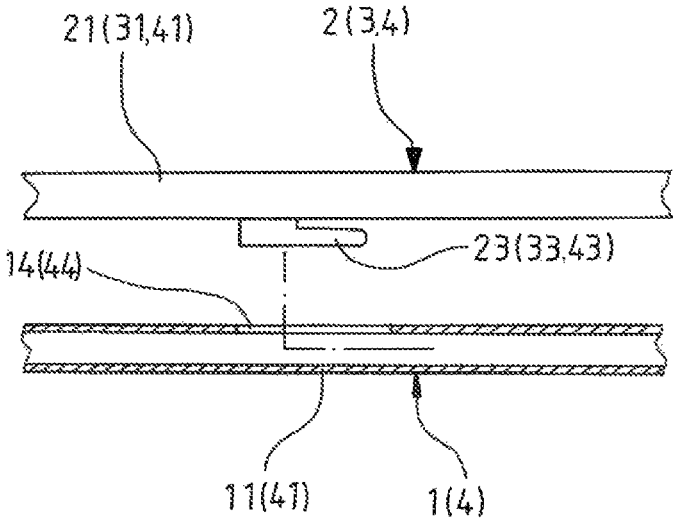
FIGS. 5 and 6 respectively show an assembly state of the present invention.
Figure 6:
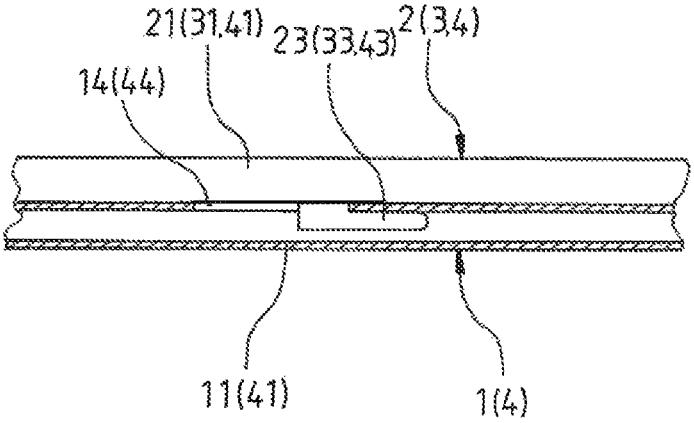

Referring to FIGS. 5 and 6, which respectively are cross-sectional views of the present invention before and after assembly, and also referring to FIG. 2 again, the buckling elements 23, 33, 43 of the front board 2, rear board 3 and two side boards 4 respectively are an L-typed body with a vertical section and horizontal section. Upon assembly, the buckling elements 23, 33, 43 are respectively first inserted into the engagement grooves 14, 44 and then slid to the ends thereof in such a way to respectively buckle the horizontal sections of the buckling elements 23, 33, 43 tightly to the outer frames 11, 41 and further to fix the front board 2, rear board 3 and two side boards 4 tightly to the bottom board 1.

Figure 7:
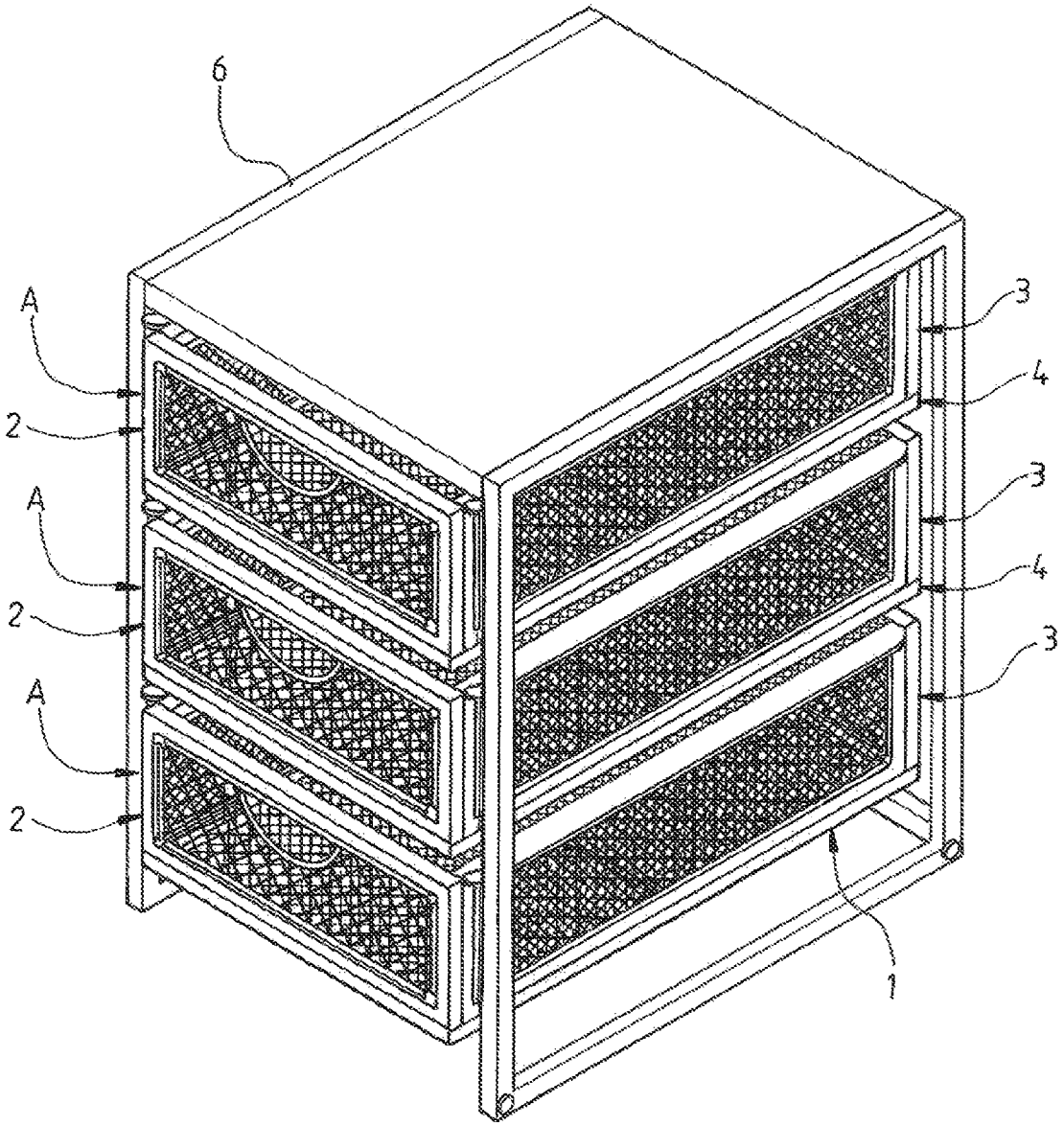
FIG. 7 shows a use state of the present invention.

Referring to FIG. 7, which is a perspective view of the present invention in a use state, one single drawer A can be slid into a cupboard 6 through the wall portions 46 configured on the side boards 4 after being assembled for the accommodation of clothes or other various articles, or it can be pulled out from the cupboard 6 so as to take out clothes or other various articles (using a hand to hold the semicircular opening 243 opened on the mesh sheet body 24 so as to facilitate pushing it in or pulling it out). In addition, all the boards can be detached from each other and stacked together so as to facilitate handling and storage when not in use.

I claim:

1. A modular drawer structure, comprising:

a bottom board, configured with an outer frame and a positioning frame configured on an inner edge of said outer frame, fixing holes being respectively configured on front and rear edges of said outer frame, and engagement grooves being respectively configured on two sides thereof, said positioning frame being configured with a mesh sheet body constituted by interwoven net threads;

a front board, configured with an outer frame and a positioning frame configured on an inner edge of said outer frame, buckling elements being configured on a rear edge of said outer frame, said positioning frame being configured with a mesh sheet body constituted by interwoven net threads, and a bottom edge of said outer frame of said front board being opened with screw holes corresponding to said fixing holes on said front edge of said outer frame of said bottom board;

a rear board, configured with an outer frame and a positioning frame configured on an inner edge of said outer frame, buckling elements being configured on a front edge of said outer frame, said positioning frame being configured with a mesh sheet body constituted by interwoven net threads, a bottom edge of said outer frame of said rear board being opened with screw holes corresponding to said fixing holes on said rear edge of said outer frame of said bottom board;

two side boards, each thereof being configured with an outer frame and a positioning frame configured on an inner edge of said outer frame, buckling elements being configured on a bottom edge of said outer frame, engagement grooves being respectively configured on front and rear edges thereof, said positioning frame being configured with a mesh sheet body constituted by interwoven net threads, and wall portions being projected out from a top edge of said outer frame;

whereby, upon assembly, said front board, rear board and two side boards are allowed to be positioned vertically on a peripheral of said bottom board by means of mutual engagements of said buckling elements and engagement grooves configured on said bottom board, front board, rear board and two side boards with each other, and screws are used to pass through said fixing holes of said bottom board to lock down said front board and rear board in such a way to constitute a box-typed drawer, and thus, said drawer is slid into a cupboard through said wall portions configured on said two side boards for the accommodation of clothes or other various articles, and all said boards are detached from each other and stacked together while not in use so as to facilitate handling and storage.

2. The modular drawer structure according claim 1, wherein said buckling elements configured on said front board, rear board and two side boards each is a L-shaped body comprising a vertical section and horizontal section; upon assembly, said buckling element is first inserted in said engagement groove of said outer frame of said bottom board, and said buckling element is then slid toward one end of said engagement groove, allowing said horizontal section to be engaged with said engagement groove tightly.

3. The modular drawer structure according to claim 1, wherein end portions of said net threads of said mesh sheet bodies configured on said bottom board, front board, rear board and two side boards are wound around said respective positioning frames, allowing said end portions to be sandwiched between said respective outer frames and positioning frames so as to make said mesh sheet bodies more stable.

4. The modular drawer structure according to claim 1, wherein said mesh sheet bodies configured on said bottom board, front board, rear board and two side boards are respectively configured with floating protrusions spaced at intervals in such a way to strengthen said respective mesh sheet body.

5. The modular drawer structure according to claim 1, wherein said mesh sheet body of said front board is opened with a semicircular opening so as to facilitate a hand pushing or pulling said drawer.

* * * * *